US006397792B1

(12) United States Patent
Heinemann

(10) Patent No.: US 6,397,792 B1
(45) Date of Patent: Jun. 4, 2002

(54) INTERNAL COMBUSTION ENGINE WITH A FLUID COOLING SYSTEM

(75) Inventor: Rolf Heinemann, Lehre (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 09/646,997

(22) PCT Filed: Feb. 17, 1999

(86) PCT No.: PCT/EP99/01045

§ 371 (c)(1),
(2), (4) Date: Sep. 25, 2000

(87) PCT Pub. No.: WO99/49201

PCT Pub. Date: Sep. 30, 1999

(30) Foreign Application Priority Data

Mar. 24, 1998 (DE) ..... 198 12 831

(51) Int. Cl.[7] ..... F02B 75/18
(52) U.S. Cl. ..... 123/41.74
(58) Field of Search ..... 123/41.74

(56) References Cited

U.S. PATENT DOCUMENTS 4,455,972 A 6/1984 Kawakami
4,686,943 A * 8/1987 Anno et al. ..... 123/41.74
4,846,116 A * 7/1989 Sakurahara ..... 123/41.74

FOREIGN PATENT DOCUMENTS

| | | |
|---|---|---|
| DE | 2 058 094 | 7/1971 |
| DE | 24 17 925 | 10/1974 |
| DE | 27 56 006 | 7/1978 |
| DE | 33 10 957 | 11/1983 |
| DE | 32 47 663 | 4/1984 |
| DE | 35 12 104 | 10/1986 |
| DE | 41 40 772 | 6/1992 |
| EP | 0 196 635 | 10/1986 |
| EP | 0 671 552 | 9/1995 |
| EP | 0 752 524 | 1/1997 |

* cited by examiner

*Primary Examiner*—Noah P. Kamen
(74) *Attorney, Agent, or Firm*—Cohen, Pontani, Lieberman & Pavane

(57) ABSTRACT

The invention relates to an internal combustion engine with at least one cylinder bank of cylinders (12) arranged in a row in at least one cylinder block, and at least one fluid cooling system allocated to a particular cylinder bank. Said fluid cooling system has at least one fluid channel (10) configured in a cylinder block. This fluid channel (10) conducts fluid through the cylinder block in order to provide a water jacket adjacent to the cylinders (12) for cooling the same. Said fluid channel (10) is delimited by a floor (16) on the crankcase side in a cylinder block situated between a cylinder head and the crankcase. This floor (16) of the fluid channel (10) is configured in the form of a curved plane.

9 Claims, 1 Drawing Sheet

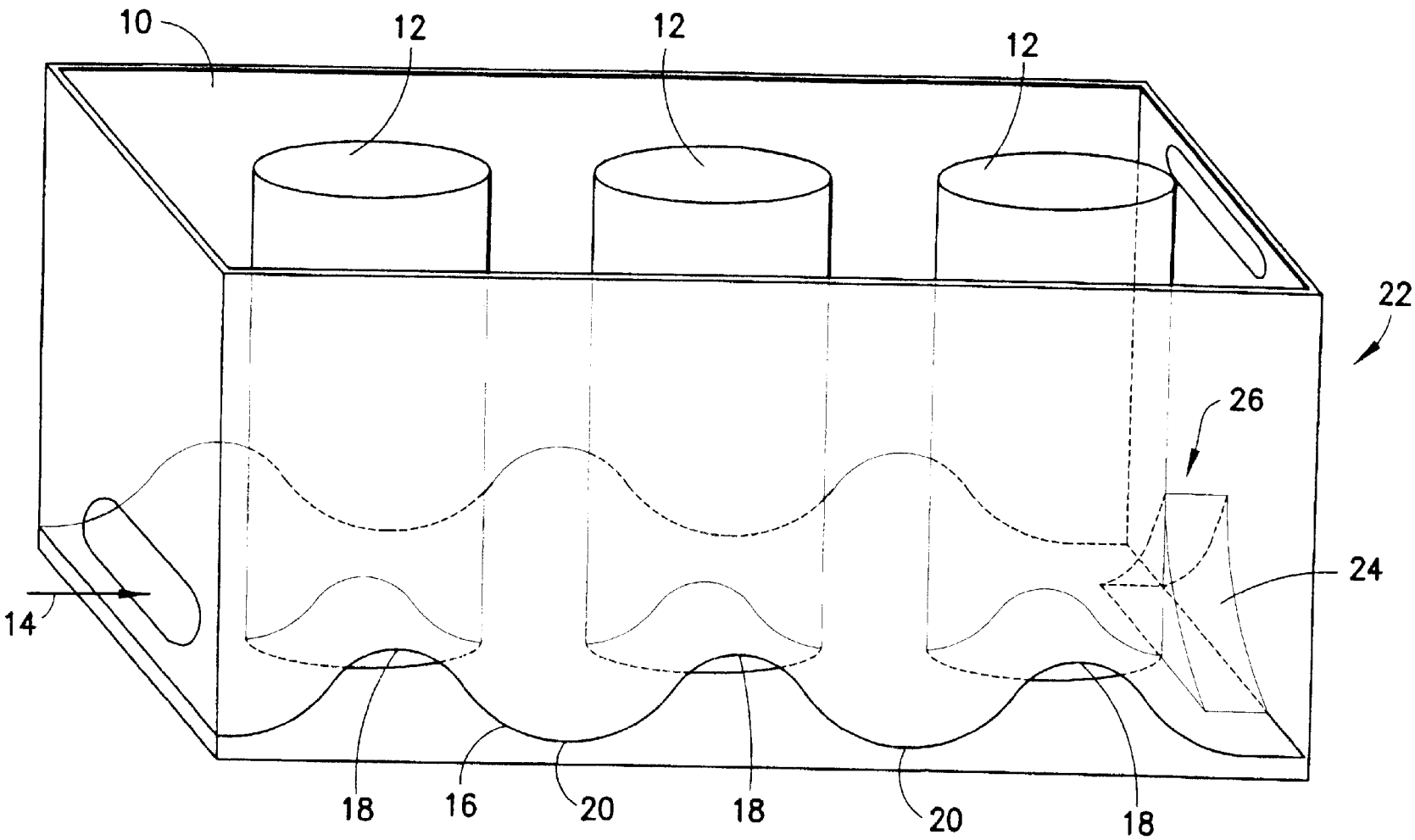
22
24
26
12
12
12
10
18
20
18
20
16
18
14

INTERNAL COMBUSTION ENGINE WITH A FLUID COOLING SYSTEM

BACKGROUND OF THE INVENTION

1. Field of the Invention

The invent ion relates to an internal combustion engine having at least one bank of cylinders arranged in a row in at least one cylinder block, and having at least one fluid cooling system which is assigned to a respective cylinder bank and has at least one fluid channel which is formed in the cylinder block and which conducts fluid through the cylinder block as a water jacket adjacent to the cylinders in order to cool them. The fluid channel is delimited by a floor on the crankcase side in the cylinder block arranged between a cylinder head and a crankcase.

2. Discussion of the Prior Art

In order to cool cylinders of an internal combustion engine, it is customary to fashion a cooling water channel in the cylinder block in the form of a water box through which water flows as cooling medium and which surrounds the cylinders with a water jacket. The problem arises in this case, however, of turbulent flows which separate at the floor of the cooling water cavities, particularly in the case of a high rate of flow of the cooling water.

U.S. Pat. No. 4,455,972 describes a cylinder block with a water box, a wall which extends in the direction of flow dividing the water box into an upper section and a lower section. Seen in the direction of flow, in this case the dividing wall is fashioned obliquely in such a way that the upper section narrows, whereas the lower section widens. However, this arrangement is complicated and, owing to the additional wall, leads to turbulent flows which prevent thermal energy from being transported away by the cooling water.

European reference EP 0 671 552 B1 discloses a cooling system for a reciprocating internal combustion in which, an upper partial channel system assigned to the combustion chambers of the cylinders is open toward a cylinder head and forms a standard upper channel system together with cooling liquid chambers in the cylinder head. The cooling liquid chambers, located in the cylinder head, of the partial channel system in the cylinder block are supplied with cooling liquid by means of several passages distributed over a cylinder head base plate. However, in this case, too, substantial disadvantages are produced by additional instances of turbulence, in particular at the passages on the cylinder head base plate.

European reference EP 0 752 524 A1 discloses a cooling water jacket in a cylinder block for cylinders of an internal combustion engine in which, there is a stepwise narrowing of a flow width perpendicular to the direction of flow of the coolant in the direction of a crankcase sealing the cylinder block, that is to say a narrowing from top to bottom. However, these steps lead to undesired instances of turbulence in the water flow, and correspondingly hinder the cooling function of the flowing water.

European reference EP 0 196 635 A2 describes an internal combustion engine with at least two liquid-cooled cylinders situated one behind the other. A flow cross section of a cooling chamber between the cylinder block wall and cylinder wall is larger on one side of a respective cylinder than on a correspondingly opposite side. Wide and narrow sections alternate from cylinder to cylinder in the direction of flow. This has the disadvantage, however, that at corresponding transition sites between wide and narrow sections instances of turbulence arise in the cooling liquid flow which correspondingly restrict effective dissipation of thermal energy by the cooling water.

German reference DE 32 47 663 C1 discloses a cylinder block for an internal combustion engine in which, cooling water cavities in the cylinder block surround corresponding cylinders constructed in the cylinder block. A lower region of the cooling water cavities is partially filled up by an inserted, heat-resistant plastic material. Although the cylinder block can subsequently be appropriately adapted thereby to different requirements relating to the cooling conditions, this is complicated and cost-intensive. Furthermore, the filled-up cooling water cavity corresponds just to a cavity correspondingly finished to be smaller as early as during production of the cylinder block. No account is taken, in particular, of hydrodynamic conditions relating to turbulent flows which separate at the floor of the cooling water cavities, especially in the case of a high rate of flow of the cooling water.

German reference DE 24 17 925 C2 discloses a liquid-cooled multicylinder internal combustion engine, there being provided separately from a water jacket surrounding the cylinders an additional coolant chamber which narrows horizontally in the direction of flow and opens into the water jacket downstream. However, in this case different rates of flow and flow vectors of the merging flows give rise to a turbulent flow, especially in the region where opening occurs. These instances of turbulence prevent heat from being transported away by the cooling medium.

German reference DE-A 2 058 094 describes a liquid-cooled multicylinder internal combustion engine with a cooling water channel which is cast into a cooling water chamber of a crankcase and is open in the direction of a cylinder head, and whose cross section decreases continuously starting from a feed point for cooling water. This arrangement, too, does not take account of the fact that turbulent flows separate at the floor of the cooling water cavities, especially in the case of a high rate of flow of the cooling water.

German reference DE 41 40 772 A1 discloses a device for cooling lands between cylinders of a cylinder block of an internal combustion engine. These lands are arranged between cylinders cast together at least in the region of a cylinder block of an internal combustion engine, and have cooling channels. However, turbulent flow which impairs the cooling function of the coolant comes about precisely when the flow enters or exits the cooling channels of the lands.

SUMMARY OF THE INVENTION

It is therefore the object of the present invention to provide an internal combustion engine of the above-named type, the above-named disadvantages being, overcome, and optimized laminar flow of the cooling fluid over the entire length of a cooling channel in the cylinder block being achieved.

This object is achieved according to the invention by means of an internal combustion engine of the above-named type in which a cooling fluid system is assigned to a respective cylinder bank and has at least one fluid channel which is formed on the cylinder block so as to conduct fluid through the cylinder block as a fluid jacket adjacent to the cylinders in order to cool them. The fluid channel is delimited by a floor in the crankcase side in the cylinder block arranged between a cylinder head and the crank.

For this purpose, the invention provides that the floor of the fluid channel is fashioned in the form of a curved plane.

This has the advantage that this fashioning of the floor of the fluid channel makes available a higher laminar flow with optimum disposal of thermal energy without high power losses for a fluid pump through instances of turbulence in the fluid flow. This advantageously results in a fluid cooling system having a lower weight and a smaller required, fluid quantity.

The curved plane is expediently fashioned in such a way that several elevations which succeed one another in the direction of flow of the fluid in the fluid channel are formed with troughs situated correspondingly therebetween, the elevations and troughs preferably following one another cyclically.

Since the water box formed by the fluid channel is less extended in the region of the cylinders, it is possible to more effectively manage a cylinder pipe distortion during operation of the internal combustion engine.

A particularly good laminar flow over the entire length of the fluid channel in the cylinder block is achieved by virtue of the fact that the plane is a continuously differentiable curve in cross section.

Guidance of the fluid flow in the fluid channel that is particularly low in turbulence is achieved by virtue of the fact that the plane is a sinusoidal curve or cosinusoidal curve in cross section.

A homogeneous flow with far-reaching avoidance of instances of turbulence upon confluence of the fluid flows from fluid channels arranged on both sides of the cylinders is achieved by virtue of the fact that at an end of the fluid channel which is removed from the flow and at which the fluid channels on both sides are reunited, the floor has an elevation which extends in the direction of the cylinder head by a predetermined length and which deflects the respective fluid flows of the channels on both sides upwardly in the direction of a cylinder head before they flow together again.

In a preferred embodiment, the fluid channel is closed by a deck (closed deck) or open on the side of the cylinder head, the latter variant advantageously implementing a fluid-conducting connection to a fluid system in the cylinder head in the so-called open-deck design.

A particularly effective cooling and dissipation of thermal energy are achieved by virtue of the fact that the fluid is water.

Further features, advantages and advantageous refinements of the invention follow from the description of the invention given below with the aid of the attached drawing.

BRIEF DESCRIPTION OF THE DRAWINGS

FIG. 1 is a schematic representation of the present invention.

DETAILED DESCRIPTION OF THE PREFERRED EMBODIMENTS

The drawing shows schematically a preferred embodiment of a water box which forms a fluid channel 10 about cylinders 12 of an internal combustion engine (not otherwise shown in more detail), through which a cooling fluid, such as cooling water, for example, flows in the direction of the arrow 14. The fluid flows around the cylinders 12 and cools the cylinders 12, by virtue of the fact that the fluid transports thermal energy away from the cylinder walls.

The water box or the fluid channel 10 is bounded below by a floor 16 in the FIGURE. The floor 16 is fashioned as a curved surface, the surface running in a corrugated fashion constituting a sinusoidal curve in a cross section along the direction of flow 14. However, according to the invention any other curvature with cyclically or non-cyclically succeeding crests and troughs is possible. Seen in the direction of flow, wave crests 18 and wave troughs 20 follow one another alternately on the floor 16 in this exemplary embodiment. Thus, in the region of the floor 16 the flow of the fluid follows this sinusoidal curve, formation of instances of turbulence largely being avoided by such guidance of the flow at the floor even in the case of high rates of flow. Furthermore, such a forced flow improves distribution and thorough mixing of the fluid in the water box, with the result that better cooling with a lesser fluid quantity is possible.

The curved surface of the floor 16 is fashioned in this case by way of example so that wave crests 18 are formed essentially at the cylinders 12. The result of this is that pipe distortion of the cylinders 12 during operation of the internal combustion engine can be more effectively managed by means of a geometry for passing the fluid around the cylinders 12 which is fashioned in accordance with the distribution of the thermal energy at the cylinder walls.

It is also advantageous additionally to superimpose a conical course of the floor 16 on the corrugated form of the floor 16 in such a way that the water box or the fluid channel 10 tapers vertically with reference to the FIGURE in the direction of flow. This additionally produces an increased rate of flow, with the result that even cylinders 12 situated further back in the direction of flow are cooled by the fluid, which has certainly already been heated but is flowing more quickly, in return, in the same way as the front cylinders 12.

The fluid flow flowing on both sides of the cylinders 12 recombines at a downstream end 22 of the water box removed from the flow, and leaves the cylinder block in a return line to a radiator, or flows into a cylinder head situated above. In order to avoid turbulent flow in this region, the invention additionally provides an elevation 24 which extends from the floor 16 in the direction of the cylinder head. This elevation 24 is formed so that it deflects the flows of the fluid on both sides upward in the direction of the cylinder head in the FIGURE, with the result that the two partial flows flow into one another without especially forming eddies, doing so at an end 26 of the elevation 24 removed from the flow. The elevation 24 extends in this case over a predetermined length in the direction of a cylinder head (in the upward direction in the FIGURE). In a preferred embodiment, the elevation 24 rises over an entire height of the water box as far as a separating plane between the cylinder block and cylinder head.

The thorough mixing in a fashion free from eddies or turbulence at the upper end 26 of the elevation 24 comes about by virtue of the fact that by being deflected the partial flows on both sides have flow vectors which are essentially identically directed. Moreover, water is specifically fed to the cylinder head by the elevation.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An internal combustion engine, comprising:

a crankcase;

a cylinder block having at least one bank of cylinders arranged in a row; and a fluid cooling system assigned to a respective cylinder bank and having at least one fluid channel which is formed in the cylinder block so as to conduct fluid through the cylinder block as a fluid jacket adjacent to the cylinders in order to cool them, the fluid channel being delimited by a floor on a crankcase side in the cylinder block arranged between a cylinder head and the crankcase, the floor of the fluid channel being formed, in a longitudinal direction extending along the row of cylinders, as a curved plane so that the floor has a varying cross-sectional thickness.

2. An internal combustion engine as defined in claim 1, wherein the curved plane has a plurality of elevations which succeed one another in a direction of flow of fluid in the fluid channel with troughs situated correspondingly therebetween.

3. An internal combustion engine as defined in claim 2, wherein the elevations and the troughs follow one another cyclically.

4. An internal combustion engine as defined in claim 2, wherein the elevations are arranged in a region of the cylinders.

5. An internal combustion engine as defined in claim 1, wherein the plane is a continuously differentiable curve in cross section.

6. An internal combustion engine as defined in claim 1, wherein the plane is one of a sinusoidal curve and a cosinusoidal curve in cross section.

7. An internal combustion engine as defined in claim 1, wherein the fluid channel is formed on both sides of the cylinders.

8. An internal combustion engine as defined in claim 7, wherein at a downstream end of the fluid channel, the floor has an elevation which extends in a direction of the cylinder head by a predetermined length and so as to deflect fluid flows on both sides of the cylinders upwardly in the direction of the cylinder head before the flows combine.

9. An internal combustion engine as defined in claim 1, wherein the block is adapted to use water.

* * * * *